United States Patent [19]

Pilon

[11] Patent Number: 4,529,090

[45] Date of Patent: Jul. 16, 1985

[54] BAG CONSTRUCTION WITH MOUNTING TAB

[75] Inventor: Terry C. Pilon, Hartsville, S.C.

[73] Assignee: Sonoco Products Company, Hartsville, S.C.

[21] Appl. No.: 623,887

[22] Filed: Jun. 25, 1984

[51] Int. Cl.[3] ..... B65D 1/34; B65D 6/04

[52] U.S. Cl. ..... 206/554; 206/526; 206/494; 383/8; 383/9; 383/903

[58] Field of Search ..... 206/554, 494, 449, 526; 383/8, 9, 903

[56] References Cited

U.S. PATENT DOCUMENTS

| | | | |
|---|---|---|---|
| 3,352,411 | 11/1967 | Schwarzkopf | 206/554 |
| 3,774,838 | 10/1971 | Christie . | |
| 3,920,122 | 11/1975 | Koehlinger et al. | 206/390 |
| 4,062,170 | 12/1977 | Orem | 53/390 |
| 4,165,832 | 8/1979 | Kuklies et al. | 383/8 |
| 4,199,122 | 4/1980 | Christie | 248/97 |
| 4,476,979 | 10/1984 | Reimann et al. | 383/903 |
| 4,480,750 | 11/1984 | Dancy | 206/554 |

FOREIGN PATENT DOCUMENTS

| | | | |
|---|---|---|---|
| 2803961 | 8/1978 | Fed. Rep. of Germany | 206/554 |

*Primary Examiner*—William T. Dixson, Jr.
*Assistant Examiner*—Brenda J. Ehrhardt
*Attorney, Agent, or Firm*—Dennison, Meserole, Pollack & Scheiner

[57] ABSTRACT

A plastic bag having front and rear walls, an open bag mouth, and a detachable tab upwardly projecting from the front and rear walls centrally along the bag mouth. The tab is integral with the bag walls at a pair of opposed readily severable areas below the bag mouth, and non-integral with the bag walls between the severable areas. The bags are provided in packs with the bag secured at the tabs.

13 Claims, 4 Drawing Figures

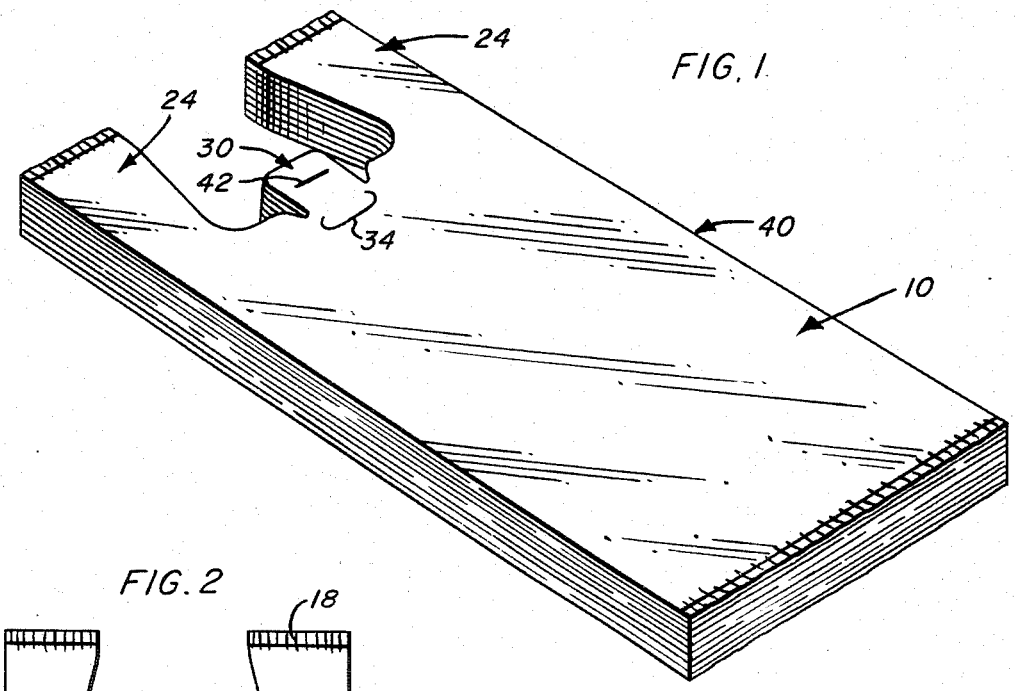
FIG. 1
FIG. 2
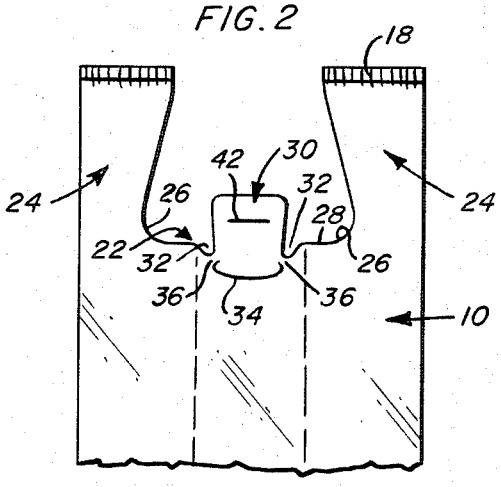
FIG. 3
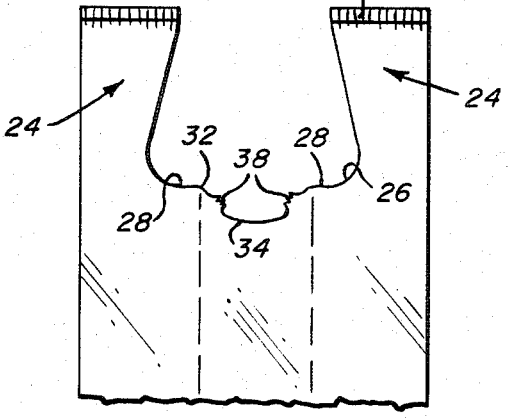
FIG. 4
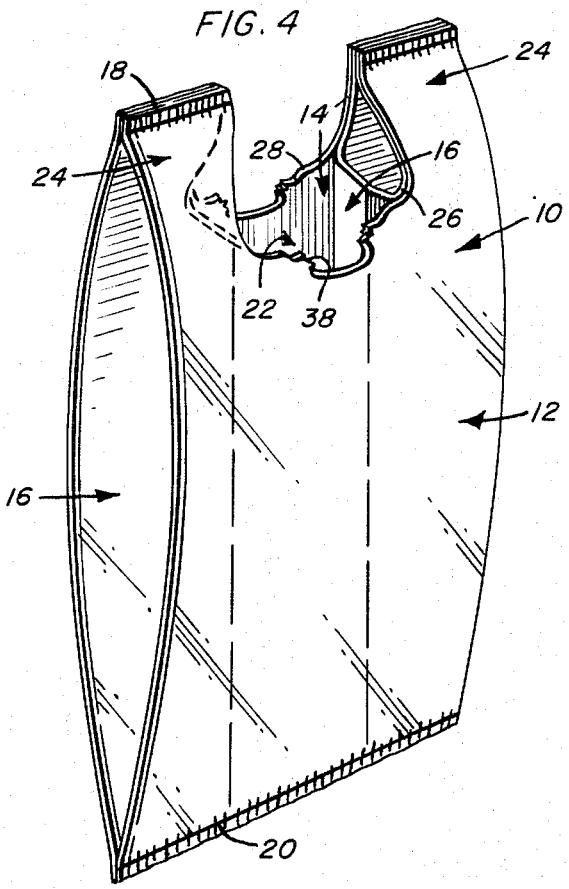

BAG CONSTRUCTION WITH MOUNTING TAB

BACKGROUND OF THE INVENTION

1. Field of the Invention

The invention is concerned with thermoplastic bag construction, and more particularly the construction of bags to be supplied in multiple bag packs wherein the bags are interlocked by severable tabs which allow for a separate dispensing of the individual bags. Such bags normally incorporate integral handles and are mountable on a dispensing rack by the tabs with the individual bags being detached from the tabs and the pack by physically pulling the bag from the rack.

The bags are frequently formed of flattened tube portions selectively severed from a length of tubing of appropriate material and subsequently heat sealed along the upper and lower edges thereof. An appropriate mouth-defining U-shaped cutout is normally made through the sealed upper edge, the cutout simultaneously defines opposed handles. The known bags have been formed both with and without side gussets.

2. Description of the Prior Art

Typical examples of the known prior art will be seen in the following patents: U.S. Pat. No. 3,352,411 Schwarzkopf; U.S. Pat. No. 3,774,838 Christie; U.S. Pat. No. 4,062,170 Orem; U.S. Pat. No. 4,165,832 Kuklies et al; U.S. Pat. No. 4,199,122 Christie.

Schwarzkopf illustrates a basic bag construction wherein a partially severed U-shaped flap forms a detachable tab. Upon separation of the bag from the flap, two integral handles are formed. The partially severed flap constitutes the means by which the bag is mounted in a pack and on a dispensing rack.

The patent of Kuklies et al discusses the general nature of the known art, as exemplified by the Schwarzkopf patent, and proposes modifications in the handle configuration, the configuration of the bag mouth, and the nature of the detachable tab. Basically, Kuklies et al provides a handle and mouth arrangement which includes an enlarged projecting detachable tab fixed centrally along the mouth by a perforated or tear area, the opposed ends of the mouth incorporating downwardly enlarged arcuate notches commencing at the handles and terminating at the tab. These notches are indicated as being for stress relief. Upon removal of the Kuklies bag from the mounting tab, the mouth of the bag is defined, along each bag wall, by a central upwardly projecting flap with a perforation-defined edge and opposed enlarged end notches. The projecting flap and perforation edge, in the high stress area of the bag mouth, form areas of potential difficulty.

Both Christie U.S. Pat. No. 4,199,122 and Orem disclose racks for stacks of handle bags. The bags in Orem include detachable perforated tabs along the mouth-defining upper edges of the bag walls.

Christie U.S. Pat. No. 3,774,838 discloses a plastic bag with integral tie portions.

SUMMARY OF THE INVENTION

The bag construction in accordance with the present invention incorporates structural improvements which substantially enhance the appearance, strength, structural stability, and ease of use of the bag. The anticipated advantages are achieved through a unique formation and configuration of the bag at the handle and mouth area thereof.

Basically, the invention involves a uniquely constructed thermoplastic handled bag or the like wherein a central detachable mounting tab is integrally formed in a manner whereby severance of the bag from the tab occurs specifically below and generally normal to the upper edge defining the mouth of the bag, along a generally vertically turned portion which is well outside those areas particularly subject to stress during the loading and handling of the bag. This in turn significantly differs from the known prior art wherein the areas of tab severance occur at or above the upper or mouth edge of the bag.

More particularly, the present invention proposes formation of the bag with an upper or mouth edge which, at the opposite ends thereof, blends into the inner edges of the lateral handles through arcuate corners. The handles increase in width upwardly from the bag mouth to form relatively greater width hand engaging portions. The mouth of the proposed bag includes a central detachable tab integral with the front and rear walls of the bag and selectively severable therefrom in a manner which avoids unsightly flaps as may interfere with the introduction and removal of commodities. The mouth edge has recesses therein immediately to the sides of the tabs with severance of the tab from the bag occurring at the recesses and below the mouth edge whereby the bag mouth has no roughened edge portions in the area of maximum stress when subjected to flexing or distortion during bag loading.

The present invention provides for the pack-forming detachable tabs as minor integral extensions formed at a central or intermediate point along the mouths of the bags. With the tabs so positioned, a multiple-bag pack can be effectively mounted on a dispensing rack for easy access to and manipulation of the individual bags for removal from the pack.

BRIEF DESCRIPTION OF THE DRAWINGS

FIG. 1 is a perspective view of a pack of bags formed in accord with the present invention;

FIG. 2 is a front elevational view of the mouth and handle end of a single bag;

FIG. 3 is a front elevational view similar to FIG. 2 with the tab detached; and FIG. 4 is a perspective view of a bag detached from the pack of bags and partially open.

DESCRIPTION OF THE PREFERRED EMBODIMENT

Referring now more specifically to the drawings, the bag 10, as illustrated, can conveniently be fabricated from a plastic tube gusseted, flattened and heat sealed at opposed upper and lower ends.

The formed bag includes planar opposed panels or walls respectively designated as front panel or wall 12 and rear panel or wall 14 for purposes of illustration. The side edges of the overlying panels 12 and 14 are interconnected by full length inwardly folded integral gussets 16 which allow for an expansion of the bag in an obvious manner.

Both the upper and lower edges of the panels 12 and 14, as well as the corresponding end edges of the gussets 16, are heat sealed throughout the length thereof as at 18 and 20. The sealed structure is then cut away inwardly and centrally through the heat sealed upper edge 18 to define both a bag mouth 22 and a pair of laterally opposed handles 24. The defined handles 24 will generally taper along the height thereof from narrow lower portions adjacent the mouth 22 of the bag to relatively wider upper end portions at the defined seam 18. In forming the tapered configuration, the opposed inner edges of the handles 24, as will be best appreciated in FIG. 2, diverge downwardly and terminate in arcuate corner portions 26 which join the vertical handle edges with the generally straight upper edge 28 of the bag mouth 22.

The detachable tab 30 is formed centrally along the upper edge of the bag mouth 22 and comprises upward integral extensions of the front and rear panels 12 and 14. This tab 30 is provided between and bordered by a pair of arcuate recesses 32 in the upper edge 28 of the bag mouth, one to each side of the central tab 30. This arrangement is clearly illustrated in the drawings and in effect provides for the base of the tab below the upper or mouth edge 28.

In order to provide for a controlled severing of the bag from the tab, an oblong cutline or slit 34 is provided transversely below the tab 30, extending through both front and rear panels 12 and 14, the tab 30 thus being non-integral with the bag panels or walls along the length of the slit. This slit 34 specifically defines a smooth edge along each bag wall, avoiding any irregularities as might encourage tearing under stress. The opposed ends of the slit 34 curl upwardly and inwardly immediately below and inward of the respective recesses 32, defining a severance or joinder area 36 of minimal thickness adjacent to and below the upper edge 28 between the inner portions of the recesses 32 and the curled ends, of slit 34. This thickness, while sufficient to provide for a positive securement of the bag and tab, also provides for a ready severance upon the introduction of a specific force thereto. The slit 34, between the curled ends, is curvilinear and defines smooth bag wall edges and a separate tab base between the joinder areas.

Noting FIGS. 2 and 3 in particular, it will be appreciated that by positioning the curled ends of the slit 34 in subjacent alignment with the recesses, and providing for a severance of the tab 30 at points corresponding to the inner or lower ends of the recesses 30, the tear area, or areas of edge disruption, generally indicated by reference numeral 38 in FIG. 3, occur below and adjacent to the uppermost edge 28 of the bag mouth, and more particularly along opposed generally vertically directed edges within a central generally curvilinear depression defined by the opposed retained portions of recesses 32 and the smooth curvilinear bottom edge, formed by the slit 34, subsequent to removal of the tab 30.

The tear areas 38, along the opposed generally vertical portions in the central depression defined by removal of the tab, are both below the upper bag edge 28 and above the smooth bottom edge defined by the slit 34. So positioned, these areas of surface disruption, caused by the physical tearing of the bag and tab from each other, are, under normal bag handling and loading conditions, subjected to little or no stress as might cause bag weakening or failure. It will also be recognized that the edges to the opposite sides of each tear area 38 are smooth and arcuately configured, avoiding any sharp disruption or areas of possible weakness therein.

It will be appreciated that the provision of the recesses or depressions 32 is significant, in conjunction with the subsequent positioning of the cutline or slit 34, in effectively lowering the base portion of the detachable tab 30 below the upper or mouth edge 28 of the bag whereby the tear areas 38 specifically occur below this upper edge. In this manner, the invention achieves the desirability of the central positioning of a single mounting tab while at the same time avoiding any structural weakening of the bag, particularly in the vulnerable mouth area thereof.

Noting FIGS. 2–4 in particular, it will be appreciated that the generally U-shaped cut which defines the handles 24 and the bag mouth 22 extends through the inner folds of the opposed gussets 16, severing the central portions of the gussets above the bag mouth 22 and providing for a loop handle construction with each handle formed of both an inner gusset layer and an outer panel layer. The formed tabs 30 will comprise two layers and, until severed, provide for a positive retention of both the panels with the inner gusset layers therebetween.

The upper portion cutout configures the front and rear panels 12 and 14 to define front and rear bag walls downward from the formed mouth 22, and upwardly extending handle-forming front and rear handle wall portions which terminate at the sealed upper edge 18 along each formed handle 24. These upwardly extending handle wall portions combine with the underlying separated gusset portions in forming what might be considered reinforced handles directly supportive of the four bag walls defined by the opposed panels and opposed gussets.

The described bag construction will normally be provided in a bag pack 40, as illustrated in FIG. 1. Such packs are formed preferably by a heat welding of the mounting tabs 30 to each other. This in turn can easily be effected simultaneously with the forming of the mounting apertures 42 through the aligned tabs 30 of a stack of bags 10 by utilizing a heated rod, blade, or the like. The rod or blade, while forming the apertures 42 through the thermoplastic material of the bag tabs, will also cause a melting and flowing of the material around the periphery of each aperture, fusing these peripheral areas together.

In use, the bag pack will normally mount over the rear portion of a rack with the bags individually forwardly drawn to detach from the tabs and engage the loop handles over opposed rack projections to maintan the individual bag upright and open. This general environment will be noted in the above referred to patents to Orem and Christie.

From the foregoing, it will be appreciated that a distinctive bag construction has been presented wherein specific provision is made to incorporate detachable mounting tabs on rack-mountable bags in a manner whereby the complete integrity of the mouth of the bag is retained, avoiding both mouth or edge weakening tear areas and edge disruptive flaps. Simultaneously, provision is made to locate the tabs in a manner whereby the bags are directly centrally supported and retained in a readily and easily accessible position for a direct physical grasping and movement thereof for disengagement from the tabs and a positioning of the individual bags in loading position.

The foregoing is considered illustrative of the principles of the invention. Suitable modifications and variations, as may occur to those skilled in the art, may be made without departing from the spirit or scope of the invention.

I claim:

1. A bag comprising front and rear bag walls, a closed bottom, and a top portion, said top portion having a pair of laterally spaced handles, said front and rear bag walls, between said handles, defining an open bag mouth, an upper mouth edge extending inwardly from each of said handles, each said handle extending above the mouth edge from a lower handle portion defining the lateral extent of said bag mouth to an upper handle portion defining a hand grip, detachable tab means intermediate the lower handle portions and projecting above said mouth edge, said mouth edge extending to each side of said tab means, recesses in said mouth edge immediately to each side of said tab means, said recesses extending below said mouth edge, said tab means having a base defined between said recesses, and force-severable means joining said detachable tab means to said bag below and adjacent said mouth edge, said force-severable means comprising an integral joinder section between the base of the tab means and each of said recesses below said mouth edge whereby severance of said bag and tab means from each other at the joinder sections forms tear areas below and adjacent said mouth edge.

2. The bag construction of claim 1 wherein said base, between said joinder sections, is non-integral with said bag walls, said tear areas formed by severance of said bag and said tab means from each other comprising the sole tear areas.

3. The bag construction of claim 2 wherein said tab means comprising a pair of overlying tab-defining planar extensions of said front and rear bag walls, and a line of severance being defined through said front and rear bag walls between said joinder sections.

4. The bag construction of claim 3 wherein said front and rear walls terminate in upper edges defining said mouth edge.

5. The bag construction of claim 4 wherein said line of severance is below said recesses.

6. The bag construction of claim 5 wherein said line of severance comprises a slit through said bag walls defined by smooth opposed edges.

7. The bag construction of claim 2 wherein the upper handle portion of each of said handles is wider than the lower handle portion thereof.

8. The bag construction of claim 3 wherein the formed tear area at the joinder sections lies along an extent generally normal to the bag mouth.

9. A bag comprising front and rear bag walls, a closed bottom, and a top portion, said top portion having a pair of laterally spaced handles, said front and rear bag walls, between said handles, defining an open bag mouth, an upper mouth edge extending inwardly from each of said handles, each of said handles extending above the mouth edge from a lower handle portion defining the lateral extent of the bag mouth to an upper handle portion defining a hand grip, detachable tab means intermediate and spaced from the lower handle portions, said tab means including a base below said mouth edge, said mouth edge extending to each side of said tab means, and joinder sections to each side of said of tab means, said joinder sections being below and adjacent said mouth edge and integrally joining said detachable tab means to said bag below and adjacent said mouth edge, said base, between the joinder sections, being free of said bag walls, said joinder sections comprising the sole means joining the detachable tab means and the bag whereby severance of said bag and tab means, including the base, from each other at the joinder sections forms tear areas solely below and adjacent said mouth edge with a depression between said joinder sections and below said mouth edge.

10. The bag construction of claim 9 including recesses in said mouth edge immediately to each side of said tab means, a line of severance defined through said bag between said joinder sections and below the tab base, said line of severance being below said recesses and including opposed ends positioned adjacent and below said recesses, each of said opposed ends, and the adjacent recess, defining therebetween one of the joinder sections.

11. The bag construction of claim 10 wherein said line of severance comprises a slit through said bag defined by smooth opposed edges.

12. The bag construction of claim 11 wherein the formed tear areas at the joinder sections lie along an extent generally normal to the bag mouth.

13. The bag construction of claim 9 wherein said bag mouth is generally straight between each lower handle portion and said tab means.

* * * * *